United States Patent [19]

Kaan et al.

[11] 4,064,963

[45] Dec. 27, 1977

[54] EXHAUST FOR INTERNAL-COMBUSTION ENGINE

[75] Inventors: Peter Kaan, Vienna; Günther Rudolf Beke, Kammersdorf, both of Austria

[73] Assignee: Vereinigte Metallwerke Ranshofen-Berndorf Aktiengesellschaft, Braunau am Inn, Ranshofen, Austria

[21] Appl. No.: 691,148

[22] Filed: May 28, 1976

[30] Foreign Application Priority Data

May 30, 1975 Austria ..... 4107/75

[51] Int. Cl.[2] ..... F01N 7/16; F01N 1/08

[52] U.S. Cl. ..... 181/244; 181/256; 181/269

[58] Field of Search ..... 181/62, 50, 53, 57, 181/60

[56] References Cited

U.S. PATENT DOCUMENTS

| | | | |
|---|---|---|---|
| 2,948,210 | 8/1960 | Conlan | 181/50 |
| 2,961,059 | 11/1960 | Blair | 181/57 |
| 3,159,238 | 12/1964 | Shearer | 181/62 |
| 3,233,697 | 2/1966 | Slayter et al. | 181/62 |
| 3,337,939 | 8/1967 | Parkinson | 181/62 |
| 3,388,769 | 6/1968 | Martoia | 181/60 |
| 3,488,723 | 1/1970 | Veazie | 181/62 |
| 3,677,365 | 7/1972 | Wright et al. | 181/62 |

*Primary Examiner*—Stephen J. Tomsky
*Attorney, Agent, or Firm*—Karl F. Ross

[57] ABSTRACT

The exhaust of an internal-combustion engine comprises a muffler of malleable aluminum or aluminum alloy with a heat-resistant inner layer extending at least along a wall portion confronting an inlet for the hot exhaust gases. The heat-resistant layer may be a refractory coating, e.g. alumina, beryllia or zirconia particles in a matrix of Teflon or silicone rubber, or a metallic liner separated from the outer wall by an airspace possibly occupied by rock wool or the like.

10 Claims, 2 Drawing Figures

EXHAUST FOR INTERNAL-COMBUSTION ENGINE

FIELD OF THE INVENTION

Our present invention relates to an exhaust for an internal-combustion engine, particularly as used in automotive vehicles.

BACKGROUND OF THE INVENTION

The mufflers employed in the exhausts of automotive engines are subject to great mechanical and thermal stresses which lead to their early deterioration. At the high temperatures involved, conventional rustproofing measures such as painting, galvanizing or alloying are largely ineffective against the corrosive action of sulphur oxides in the exhaust gases from within the system and of mud or slush from without. External coatings of enamel, for example, are relatively brittle and are therefore easily damaged by flying pebbles or gravel.

Aluminum and some of its alloys are highly resistant to corrosion but, because of their low melting point, cannot withstand prolonged exposure to high temperatures. Thus, it has already been proposed to make mufflers by high-pressure aluminum casting; such mufflers, however, were found suitable only for motorcycles and similar low-power vehicles.

OBJECTS OF THE INVENTION

The general object of our present invention, therefore, is to provide an improved muffler obviating the aforestated drawbacks.

A more particular object is to provide a muffler for high-temperature exhaust gases such as those generated in high-compression engines or in automobiles with rear motors in which the conduits between the engine and the exhaust are very short.

SUMMARY OF THE INVENTION

In accordance with our present invention, a muffler for the exhaust of an internal-combustion engine is made from a malleable metal consisting essentially of aluminum, this term being intended to include corrosion-resistant aluminum alloys. A protective layer of heat-resistant material is provided on at least a portion of the muffler wall confronting an inlet for hot exhaust gases which are to be deflected by that wall portion onto a circuitous path to an outlet.

The protective layer may be a refractory coating directly applied to the metallic wall portion, e.g. a mass of ceramic particles deposited thereon by a flame spray or with the aid of an organic binder serving as a substrate for the particles or as a bonding agent therebetween. Suitable binders resistant to hot gases include fluor-substituted or silicon-based polymers such as polytetrafluorethylene (Teflon) or silocone rubber. Suitable ceramic materials include various metal oxides such as alumina, beryllia or zirconia. Alternatively, the protective layer may be a self-supporting metallic liner spaced from the wall portion to be protected, with or without interposition of an inorganic filler such as rock wool. The liner may consist, for example, of stainless steel, titanium, or steel coated with titanium oxide.

BRIEF DESCRIPTION OF THE DRAWING

The above and other features of our invention will now be described in detail with reference to the accompanying drawing in which.

SPECIFIC DESCRIPTION

Figure 1:
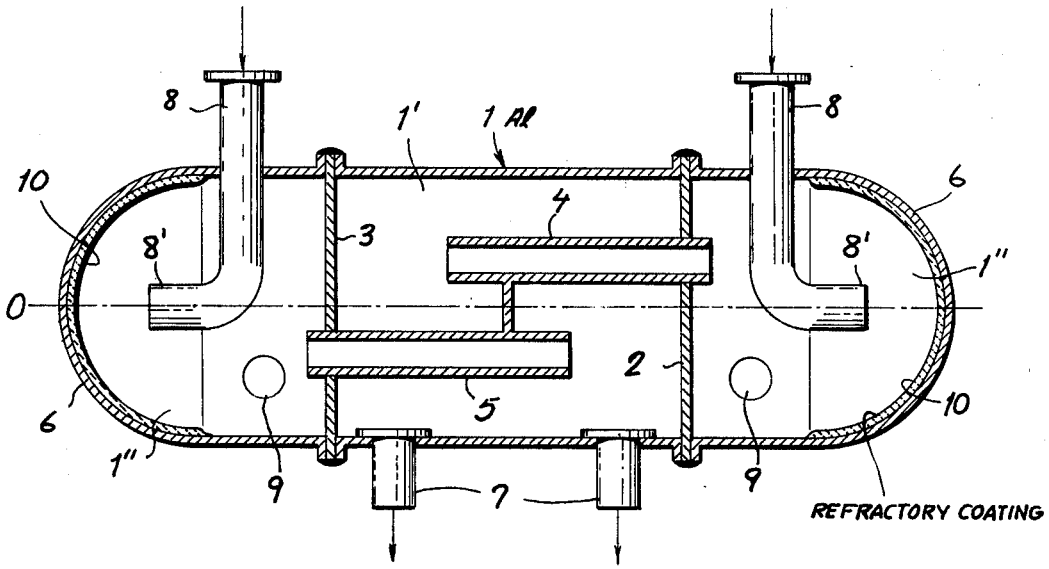
FIG. 1 is a longitudinal sectional view of a muffler embodying our invention.

In FIG. 1 we have shown a muffler 1 with a generally cylindrical body of circular cross-section, centered on an axis 0, whose interior is subdivided by two transverse partitions 2 and 3 into a central compartment 1' and two outer compartments 1''. The outer compartments 1'' are bounded by substantially hemispherical end caps 6 and receive respective inlet pipes 8 for hot exhaust gases coming from a nonillustrated automotive engine. Inlet pipes 8 have extremities 8' which are aligned with axis 0 and open onto the confronting end caps 6. Two tubes 4 and 5 traverse the partitions 2 and 3 and overlappingly extend into the central compartment 1' where the exhaust gases, reflected at the caps 6, can reach a pair of outlet ports 7. At 9 we have shown fittings for mounting the muffler on the car body.

In accordance with our present invention, the body of muffler 1 including its end caps 6 consists of a malleable and corrosion-resistant aluminum alloy, e.g. with admixture of 0.5–4.5% Mn and 0.5–2.5% Mg. The caps 6 and adjoining parts of the cylindrical peripheral muffler wall are coated by a protective layer 10 of heat-resistant material, such as ceramic particles in an organic matrix as discussed above. Because of the pressure differential existing between pipe extremities 8' and exit ports 7, the gases deflected at the end caps 6 will tend to pass outwardly via tubes 4 and 5 and will therefore have little contact with other portions of the muffler periphery. If desired, however, the layer 10 could be extended over the entire inner wall surface of the muffler body; conduits 4, 5, 7 and 8 may be similarly coated, internally and/or externally.

The intermediate portion of the muffler body can be simply produced by the rolling of a metal sheet into cylindrical shape and by welding along a longitudinal seam. The transverse sheet edges may be bent outwardly to form a pair of peripheral flanges adjoining the partitions 2 and 3 to which they can be welded by a peripheral seam. In a similar manner, the end caps 6 may be formed in a deep-drawing process with peripheral flanges to be welded onto the adjoining partitions. Naturally, the deposition of the coatings 10 and the attachment of the inlet and outlet connections occur before assembly.

Figure 2:
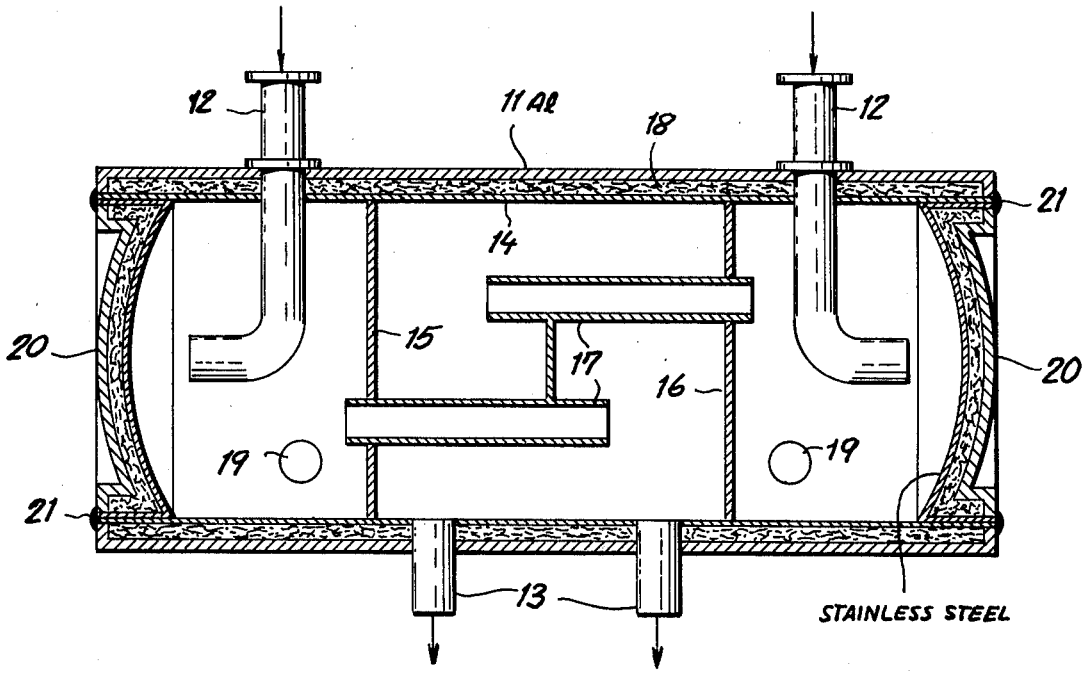
FIG. 2 is a view similar to FIG. 1, illustrating another embodiment.

The muffler shown in FIG. 2 has a body 11 in the form of a cylindrical tube of aluminum or aluminum alloy provided with internal partitions 15 and 16 traversed by tubular elements 17. Within body 11, three compartments are again formed by the partitions and by a pair of end caps 20 which in this instance are curved disks fitted into the extremities of tube 11. Inlet pipes 12 again enter the two outer compartments and have axially extending extremities open toward the end caps. The central compartment is again formed with outlet ports 13; fittings 19 serve for the mounting of the muffler on the vehicle body.

The entire muffler wall in FIG. 2 is protected by a liner 14, e.g. of stainless steel or titanium, separated from that wall by a narrow airspace which is occupied by rock wool 18. The liner 14, serving only as a heat shield, may be a foil much thinner than the muffler wall and could be ribbed or corrugated to maintain the spacing from that wall while having only limited contact therewith. The liner 14 with its partitions 15 and 16 as well as tubes 17 may be inserted into the body 11, with interposition of insulation 18, and may be held in position therein by introduction of the fittings 19 through aligned openings in the muffler wall and in the liner. The assembly is completed by emplacement of the end caps 20 which can be welded to the tube 11 along edge seams 21.

The cylindrical muffler bodies 1 and 11 of FIGS. 1 and 2 could also be provided with external fins, not shown, serving as reinforcements and to promote heat dissipation. Such finned bodies could be produced integrally by extrusion. Alternatively, the muffler body could be assembled from two molded or deep-drawn half-shells.

Parts of the muffler of FIG. 2 not protected by the liner 14, such as tubing 12, 13 and 17, could be provided with a refractory coating as in the embodiment of FIG. 1.

We claim:

1. An exhaust for an internal-combustion engine, comprising:

a muffler of a corrosion-resistant malleable metallic material consisting essentially of aluminum, said muffler having a body with a generally cylindrical peripheral wall and a pair of end caps adjoining said wall, at least said end caps being provided with a protective inner layer of heat-resistant material;

two transverse partitions dividing the interior of said body into two outer compartments bounded by said end caps and a central compartment between said partitions;

a pair of nonaligned, substantially axially extending tubular elements each traversing one of said partitions for establishing communication between said central compartment and a respective outer compartment;

a pair of inlet pipes extending substantially radially through said wall into said outer compartments for admitting hot exhaust gases into said muffler, said pipes terminating in bent extremities open toward said end caps whereby the incoming exhaust gases impinge upon said protective layer; and outlet means in said wall between said partitions for discharging the exhaust gases from said muffler.

2. An engine as defined in claim 1 wherein said tubular elements overlap each other in said central compartment.

3. An engine as defined in claim 1 wherein said end caps are concave toward said extremities.

4. An engine as defined in claim 1 wherein said muffler is composed of a plurality of sheet-metal sections welded together at their junctions.

5. An exhaust as defined in claim 1 wherein said protective layer comprises a refractory coating.

6. An exhaust as defined in claim 5 wherein said coating includes a mass of ceramic particles with an organic binder.

7. An exhaust as defined in claim 1 wherein said protective layer comprises a metallic liner spaced from said wall portion.

8. An exhaust as defined in claim 7, further comprising an inorganic filler in the space between said liner and said wall portion.

9. An exhaust as defined in claim 8 wherein said filler is rock wool.

10. An exhaust as defined in claim 1 wherein said malleable metallic material is an alloy of aluminum with manganese and magnesium.

* * * * *